US010618070B1

(12) United States Patent
Leff

(10) Patent No.: US 10,618,070 B1
(45) Date of Patent: Apr. 14, 2020

(54) MULTI-CHAMBER SPRAY BOTTLE

(71) Applicant: Lawrence Leff, Nesconset, NY (US)

(72) Inventor: Lawrence Leff, Nesconset, NY (US)

( * ) Notice: Subject to any disclaimer, the term of this patent is extended or adjusted under 35 U.S.C. 154(b) by 0 days.

(21) Appl. No.: 16/041,351

(22) Filed: Jul. 20, 2018

(51) Int. Cl.
*B05B 11/00* (2006.01)
*B05B 15/30* (2018.01)

(52) U.S. Cl.
CPC ..... *B05B 11/0078* (2013.01); *B05B 11/0097* (2013.01); *B05B 15/30* (2018.02); *B05B 11/3081* (2013.01)

(58) Field of Classification Search
CPC ..... B05B 11/0078; B05B 11/0097; B05B 11/3081; B05B 15/30
See application file for complete search history.

(56) References Cited

U.S. PATENT DOCUMENTS 5,398,846 A 3/1995 Corba et al.
5,890,624 A * 4/1999 Klima ..... B05B 11/00 222/82
5,944,223 A * 8/1999 Klima ..... B05B 11/0056 222/129
7,473,658 B2 1/2009 Acosta et al.
9,551,332 B2 1/2017 Burrowes et al.
9,662,298 B2 5/2017 Tamarkin et al.
9,925,550 B2 3/2018 Dring et al.
2006/0131331 A1 6/2006 Powell
2011/0036867 A1 2/2011 Flores
2013/0186977 A1 7/2013 Fornaro et al.
2014/0217120 A1* 8/2014 Berry ..... B05B 11/3081 222/136
2018/0009597 A1 1/2018 Sansing

* cited by examiner

*Primary Examiner* — Frederick C Nicolas
(74) *Attorney, Agent, or Firm* — Cramer Patent & Design, PLLC; Aaron R. Cramer

(57) ABSTRACT

A multi-chamber spray bottle comprises a fluid reservoir having a plurality of individual chambers disposed along a horizontal axis. Each reservoir is in fluid communication with a detachable squeeze spray adapter. The fluid reservoir has a single snap on lid providing access to the interior environment of each reservoir. A removable funnel is secured within the base of the fluid reservoir.

17 Claims, 5 Drawing Sheets

MULTI-CHAMBER SPRAY BOTTLE

RELATED APPLICATIONS

Not applicable

FIELD OF THE INVENTION

The present invention relates generally to a multi-chamber spray bottle.

BACKGROUND OF THE INVENTION

Spray pump dispensers are a common dispensing method for a variety of cleaning products such as furniture polish, bathroom cleaner, glass cleaner, general surface cleaner, car care products and the like. Since each of these products perform a dedicated cleaning task, it is necessary to often carry 3 or more to perform even the simplest of tasks such as cleaning a bathroom or sprucing up a car. This means that the typical person will try to painfully hook the multiple containers over their fingers while trying to carry other cleaning materials and supplies such as mops, rags, sponges and the like.

In addition to this problem, all of these cleaning products take up valuable space in a closet, cupboard or garage. Finally, no matter what cleaning product is closest at hand, it is just a general rule of life that whatever cleaning spray is needed at any one time is the one that is farthest away. This means that much time is wasted simply tracking down the right cleaning spray. Accordingly, there exists a need for a means by which spray-bottle based cleaning chemicals can be modified in a manner which addresses the above-mentioned disadvantages. The development of the multi reservoir spray bottle 10 fulfills this need.

SUMMARY OF THE INVENTION

To achieve the above and other objectives, the present invention provides for an a spray bottle having a spray bottle reservoir defining an interior, an orifice plate located at the top of the spray bottle reservoir which is secured by a restraining collar—the restraining collar comprising a clamp collar with a restraining clamp, a spray nozzle head having a main body supporting a discharge nozzle. The discharge nozzle comprises a trigger handle and a mechanical pump. There is also a plurality of reservoir compartments each of which are contained within an outer boundary of the spray bottle reservoir and are defined by the outer boundary and a plurality of interior dividing walls. An interior portion of each the interior dividing wall join together at an upper funnel restraining cavity. Each of the reservoir compartments include a dip tube, linear in nature and extending from a lowermost section of each reservoir compartment to the orifice plate. Each of the dip tubes carries a fluid retained within each the reservoir compartment to the spray nozzle head. Each dip tube is also presented with and routed from the orifice plate to the bottom of the reservoir compartments. When each of the dip tubes are placed into the desired reservoir compartments, the upper opening of the dip tubes allows for refilling. When the trigger handle is squeezed, the trigger operates the mechanical pump to pressurize and move a respective internal fluid to the discharge nozzle where it is discharged as an atomized spray.

The spray bottle reservoir and the spray nozzle head may be separable to allow for refilling. A fill funnel may be provided on the bottom of the spray bottle where it is stored during periods of non-use in a lower funnel restraining cavity. The lower funnel restraining cavity may follow the general profile of the fill funnel. In order to remove the fill funnel, a user may lift the spray bottle with one hand and grasp it with the aid of at least one funnel grasping means.

The spray bottle may also comprise downward pressure which may be exerted upon the fill funnel which dislodges it from a pressure holding means. The pressure holding means may be selected from the group consisting of a pressure fit, a flange fit, or a détente fitting. The restraining collar may be loosened from the orifice plate and removed from the spray bottle reservoir with the dip tubes attached thereby exposing the pie-shaped opening in the top of the spray bottle reservoir. The restraining collar may be selected from the group consisting of a threaded design, a snap design, or a twist lock design.

The orifice plate may be secured by the restraining collar which is positioned to disclose the liquid tight twist fitting. The liquid tight twist fitting may include an inner collar with two keyed lock openings. The liquid tight twist fitting may also be provided with a self-sealing membrane and an associated inner opening and the self-sealing nature of the liquid tight twist fitting that prevents the liquid from spilling from the spray bottle even if upturned.

The spray bottle may also comprise a piercing tip which engages the self-sealing membrane where an interior port engages with the respective dip tubes in an air tight manner. The insert adapter of the spray nozzle head may be aligned with the desired liquid tight twist fitting which contains the desired liquid.

In order to physically attach the spray nozzle head, the orifice plate and a set of two keyed prongs that engage the respective keyed lock openings may be locked into place with a slight angular rotation. An indicia label may be provided on each of the reservoir compartments, centered between the interior dividing walls, wherein rapid identification of the contained liquid is made.

Upon refilling, the dip tubes may be threaded back into each of the reservoir compartments, the dip tubes are replaced in the lower funnel restraining cavity and the spray nozzle head is secured to the desired liquid tight twist fitting by use of an insert adapter.

A method of preparing a spray bottle comprises the following steps: first, making a decision as to what liquids are stored and dispensed from the spray bottle; second, disengaging a spray nozzle head from a spray bottle reservoir via a twisting motion thus removing an insert adapter from the liquid tight twist fitting; third, removing a fill funnel from a lower funnel restraining cavity by the funnel grasping means manipulated against a pressure holding means; fourth, inserting dip tubes inserted into desired reservoir compartments; fifth, pouring the liquids through the fill funnel filling the reservoir compartments and repeating for the remaining reservoir compartments; sixth, replacing the orifice plate with the dip tubes atop the spray bottle reservoir and securing the orifice plate via the restraining collar; and last, engaging the spray nozzle head with a liquid tight twist fitting. The liquids may be selected from a group consisting of furniture polish, bathroom cleaner, glass cleaner, general cleaner, or car care products.

A method for utilizing the spray bottle may comprise the following steps: first, engaging a piercing tip of a spray nozzle head upon an inner collar of a liquid tight twist fitting; second, engaging an interior port upon the respective dip tubes with the keyed prongs engaging upon a plurality of keyed lock openings with an angular rotation; third, operating a trigger handle to spray a desired liquid; fourth, performing a few activations of the trigger handle to clean any remaining product from a mechanical pump and a discharge nozzle; and last, dispensing a new product.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
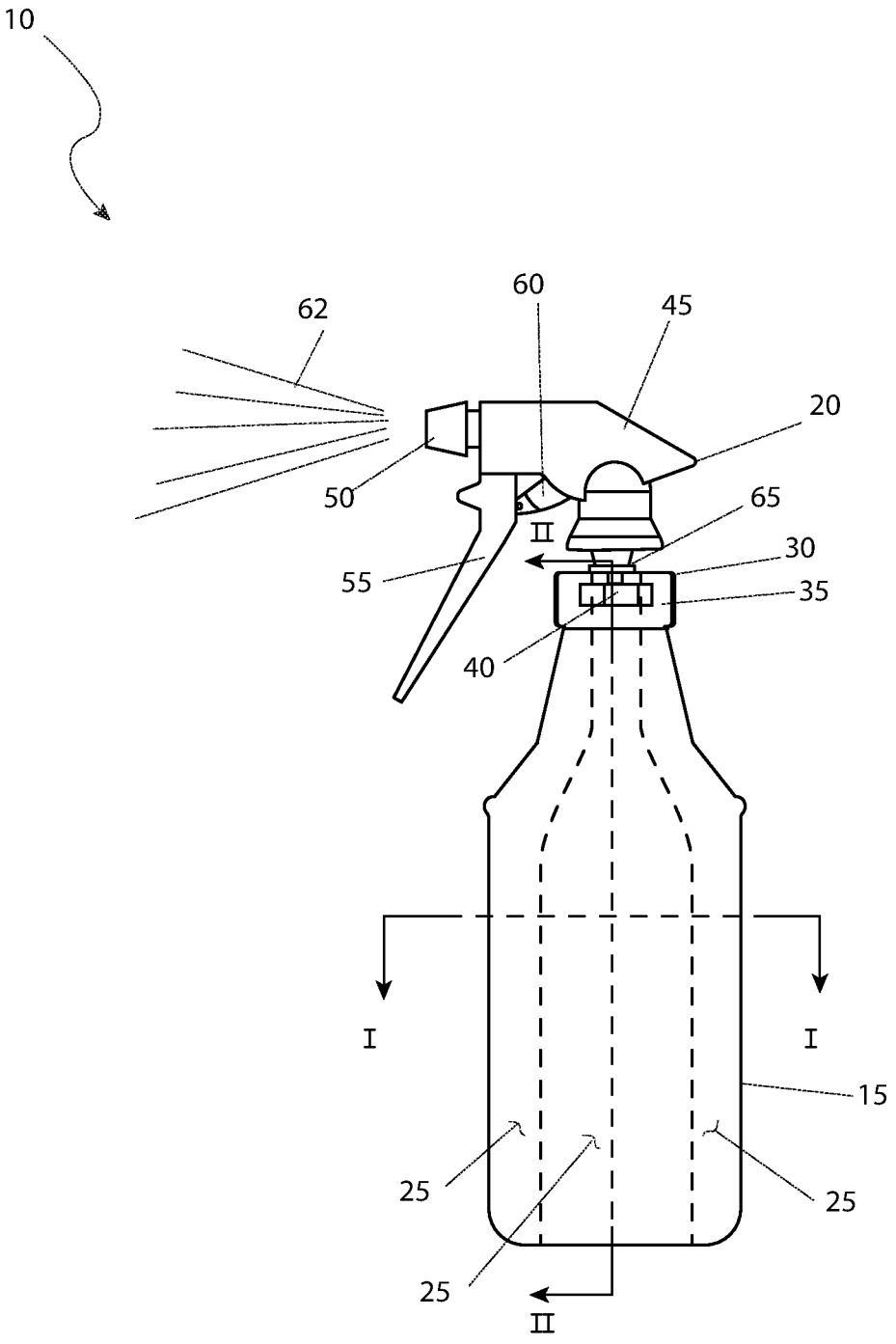
FIG. 1 is a front view of the spray bottle 10, according to the preferred embodiment of the present invention.

10 spray bottle
15 spray bottle reservoir
20 spray nozzle head
25 reservoir compartments
30 orifice plate
35 restraining collar
40 restraining clamp
45 main body
50 discharge nozzle
55 trigger handle
60 mechanical pump
62 atomized spray
65 liquid tight twist fitting
70 interior dividing wall
75 upper funnel restraining cavity
80 dip tube
85 fill funnel
90 lower funnel restraining cavity
95 funnel grasping means
100 pressure holding means
105 indicia label
110 insert adapter
115 inner collar
120 keyed lock opening
125 self-sealing membrane
130 inner opening
135 piercing tip
140 interior port
145 keyed prong
150 angular rotation

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a front view of the spray bottle 10, according to the preferred embodiment of the present invention is disclosed. The multi reservoir spray bottle 10, incorporates two (2) main components; a spray bottle reservoir 15 and a spray nozzle head 20, which are separable to allow for user refilling. The spray bottle reservoir 15 contains at least five (5) reservoir compartments 25, suitable for containing liquid based products arranged in a vertical manner as depicted by hidden lines, all of which are accessible at their uppermost point. An orifice plate 30 is located at the top of the spray bottle reservoir 15 and is secured by a restraining collar 35. The restraining collar 35 is envisioned as a clamp collar complete with a restraining clamp 40 as shown. However, other styles of restraining collar 35 can also be utilized with the spray bottle 10 with equal effectiveness such as a threaded design, snap design, twist lock design, and the like. As such, the use of any particular style of restraining collar 35 should not be interpreted as a limiting factor of the present invention.

The spray nozzle head 20 is of a conventional design and includes a main body 45 which supports a discharge nozzle 50, a trigger handle 55, and a mechanical pump 60 all of which operate in a well-known manner. As the trigger handle 55 is squeezed, it operates the mechanical pump 60 to pressurize and move the respective internal fluid to the discharge nozzle 50 where it is discharged as an atomized spray 62. The main body 45 is attached to the orifice plate 30 via a liquid tight twist fitting 65, which will be described in greater detail herein below. It is noted that most components of the spray bottle 10 are made of injection or blow molded plastic requiring the development of custom molds, with the exception of minor components of the spray nozzle head 20 such as springs, fasteners, pins, and the like, which would be made of steel or similar metals.

Figure 2:
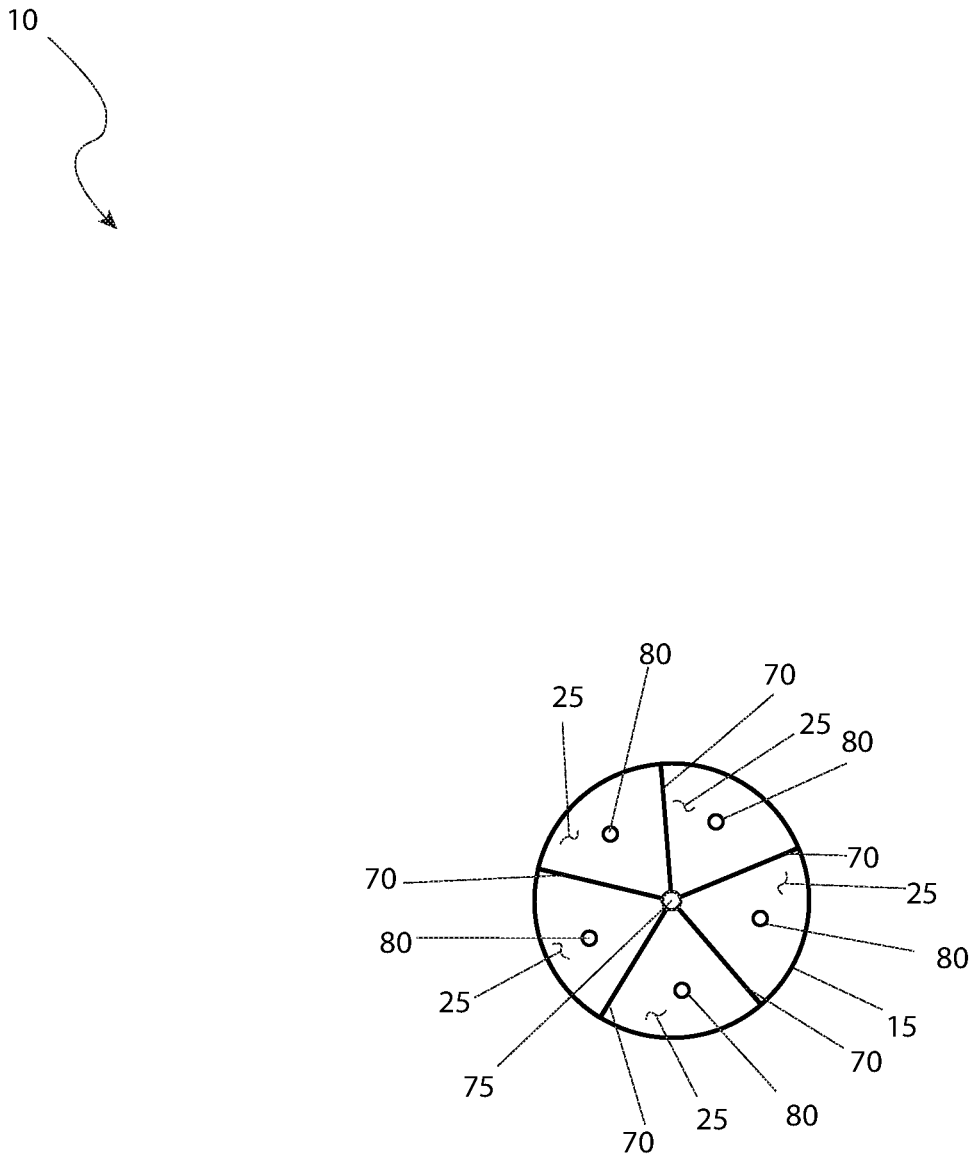
FIG. 2 is a sectional view of the spray bottle 10, as seen along a line I-I, as shown in FIG. 1, according to the preferred embodiment of the present invention.

Referring next to FIG. 2, a sectional view of the spray bottle 10, as seen along a line I-I, as shown in FIG. 1, according to the preferred embodiment of the present invention is depicted. This view clearly depicts the reservoir compartments 25 arranged in a circular and symmetrical manner. Each reservoir compartment 25 is contained within the outer boundaries of the spray bottle reservoir 15 as well as interior dividing walls 70. The interior portion of each interior dividing wall 70 join together at an upper funnel restraining cavity 75, whose functionality will be described in greater detail herein below. Finally, a set of dip tubes 80, linear in nature and extending from the lowermost section of each reservoir compartment 25 to the orifice plate 30 (as shown in FIG. 1) and thus depicted here as a circular cross section is visible. The purpose of each dip tube 80 is to carry the respective contained liquid from each reservoir compartments 25 to the spray nozzle head 20 (as shown in FIG. 1).

Figure 3:
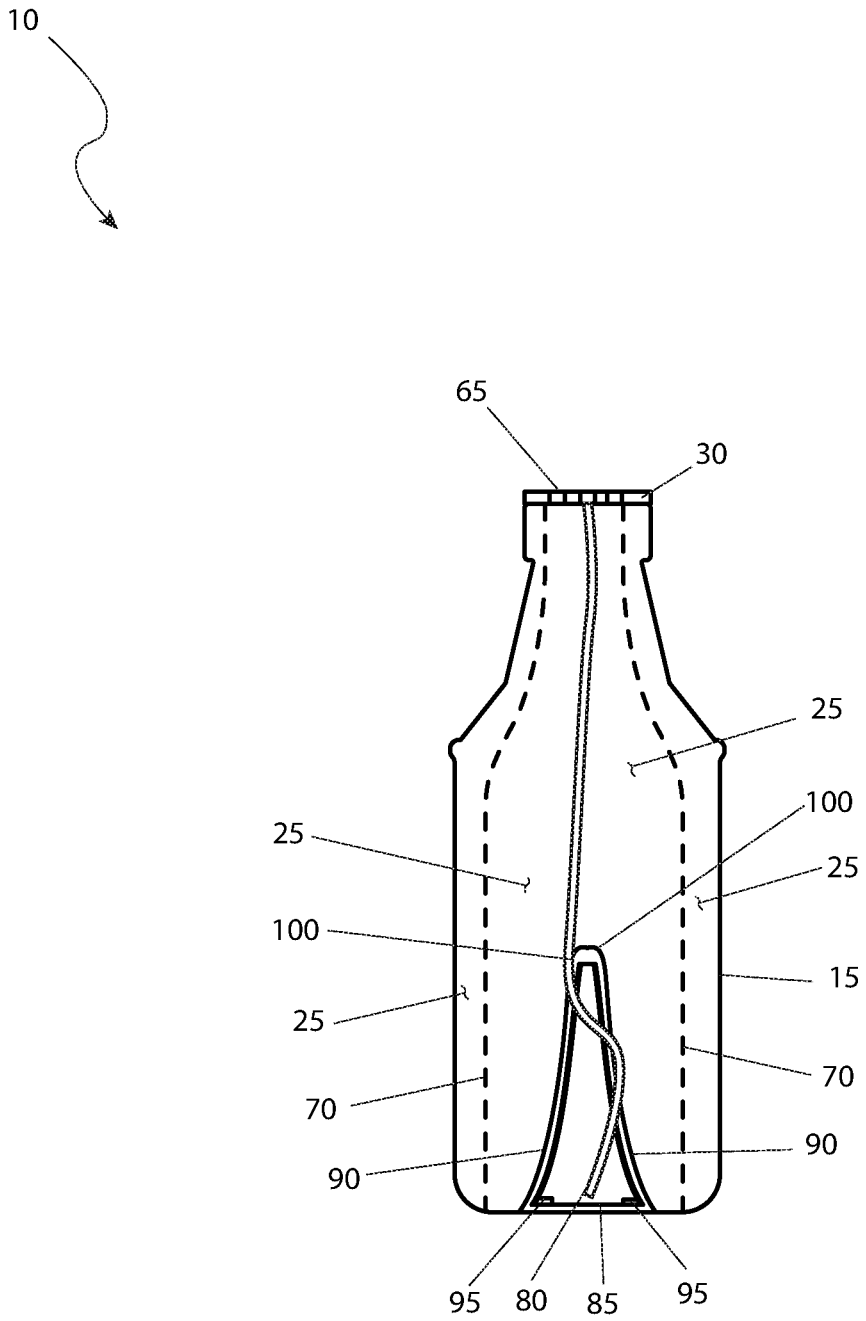
FIG. 3 is a sectional view of the spray bottle 10, as seen along a line II-II, as shown in FIG. 1, according to the preferred embodiment of the present invention.

Referring now to FIG. 3, a sectional view of the spray bottle 10, as seen along a line II-II, as shown in FIG. 1, according to the preferred embodiment of the present invention is shown. This view more clearly depicts the compartmentalized and separate nature of the reservoir compartments 25 contained within the spray bottle reservoir 15. It is noted that additional sections of reservoir compartments 25 as provided by the interior dividing walls 70 are visible and would vary dependent on the quantity of reservoir compartments 25, envisioned to be up to five (5). One (1) of the dip tubes 80 is presented and routed from the liquid tight twist fitting 65 on the orifice plate 30 to the bottom of the respective reservoir compartments 25. The remaining dip tubes 80 are not shown for purposes of illustrative clarity. A fill funnel 85 is provided on the bottom of the spray bottle 10 where it is stored during periods of non-use in a lower funnel restraining cavity 90. The lower funnel restraining cavity 90 follows the general profile of the fill funnel 85. To remove the fill funnel 85, the user lifts the spray bottle 10 with one (1) hand and grasps it with the aid of at least one (1) funnel grasping means 95 such as a lip, flange, or the like. Next, downward pressure is exerted upon the fill funnel 85 which dislodges it from a pressure holding means 100 such as pressure fit, flange fit, détente fitting or the like. Further information of the use of the fill funnel 85 will be provided herein below.

Figure 4:
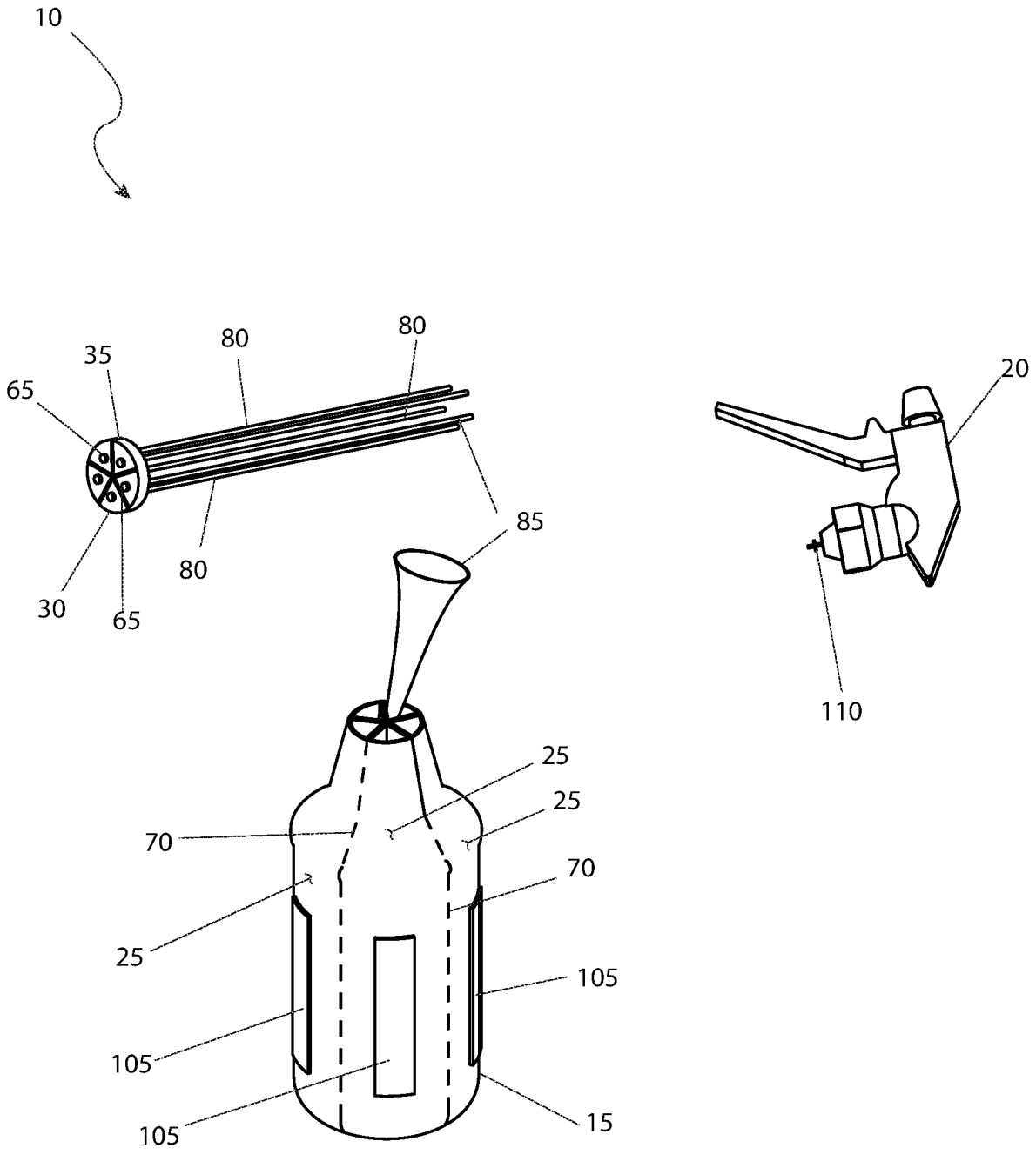
FIG. 4 is a perspective view of the spray bottle 10, shown in a state of being refilled, according to the preferred embodiment of the present invention; and, FIG. 5 is a detailed view of the liquid tight twist fitting 65 and the insert adapter 110, as used with the spray bottle 10, according to the preferred embodiment of the present invention.

Referring next to FIG. 4, a perspective view of the spray bottle 10, shown in a state of being refilled, according to the preferred embodiment of the present invention is disclosed. As many of the products dispensed by the spray bottle 10 are or may be purchased in bulk, and due to the fact that the combinations afforded by the use of the spray bottle 10 are almost limitless and governed by user preferences, it is envisioned that the spray bottle 10 would be initially purchased in an empty state and filled and refilled by the final user on an as-needed basis. The restraining collar 35 is loosened from the orifice plate 30 and removed from the spray bottle reservoir 15 with all dip tubes 80 attached. This exposes the "pie-shaped" opening in the top of the spray bottle reservoir 15, as the individual compartments are too small to refill each reservoir compartments 25 without cross contamination of the adjacent reservoir compartments 25, the dip tubes 80 is placed into the desired reservoir compartments 25 whereupon the large mouth upper opening of the dip tubes 80 allows for easy refilling. An indicia label 105 may be provided on each reservoir compartments 25, centered between the interior dividing walls 70, such that rapid identification of the contained liquid can be made at a later time. After refilling, the respective dip tubes 80 are threaded back into each reservoir compartments 25, the dip tubes 80 replaced in the lower funnel restraining cavity 90 (as shown in FIG. 3), and the spray nozzle head 20 is secured to the desired liquid tight twist fitting 65 by use of an insert adapter 110. The coupling between the insert adapter 110 and the liquid tight twist fitting 65 will be described in greater detail herein below.

Figure 5:
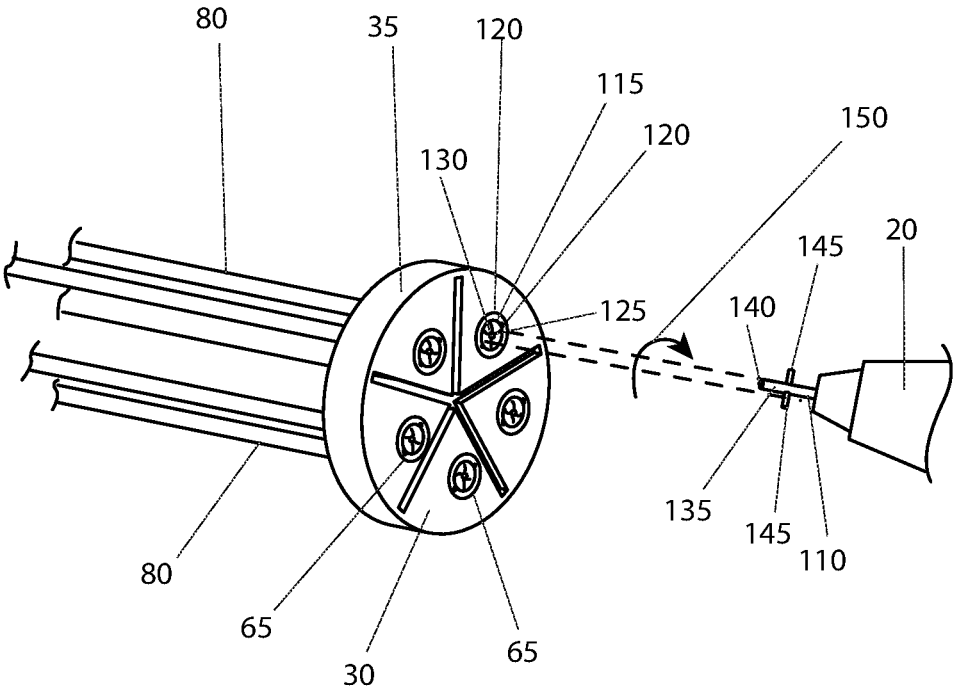

Referring final to FIG. 5, a detailed view of the liquid tight twist fitting 65 and the insert adapter 110, as used with the spray bottle 10, according to the preferred embodiment of the present invention is depicted. The orifice plate 30, as secured by the restraining collar 35, with the trailing dip tubes 80 behind, is positioned to disclose the liquid tight twist fitting 65. Each liquid tight twist fitting 65 includes an inner collar 115 with two (2) keyed lock openings 120. The liquid tight twist fitting 65 is then provided with a self-sealing membrane 125 and an associated inner opening 130. The self-sealing nature of the liquid tight twist fitting 65 prevents liquid from spilling from the spray bottle 10 even if upturned. The insert adapter 110 of the spray nozzle head 20 is then aligned with the desired liquid tight twist fitting 65 which contains the desired liquid. A piercing tip 135 then engages the self-sealing membrane 125 such that an interior port 140 engages with the respective dip tubes 80 in an air tight manner. To physically attach the spray nozzle head 20 the orifice plate 30, a set of two (2) keyed prongs 145 engage the respective keyed lock openings 120, whereupon a slight angular rotation 150 locks it into place.

2. Operation of the Preferred Embodiment

The preferred embodiment of the present invention can be utilized by the common user in a simple and effortless manner with little or no training. It is envisioned that the spray bottle 10 would be constructed in general accordance with FIG. 1 through FIG. 5. The user would procure the spray bottle 10 through normal commercial channels paying particular attention to parameters such as overall size of the spray bottle 10, number of reservoir compartments 25 afforded by the spray bottle 10, and the like. It is envisioned that the spray bottle 10 would be made in multiple versions to suit the needs of all users.

After procurement and prior to utilization, the spray bottle 10 would be prepared in the following manner: a decision would be made as to what liquids are to stored and dispensed from the spray bottle 10 including but not limited to: furniture polish, bathroom cleaner, glass cleaner, general cleaner, car care products or the like; the spray nozzle head 20 would be disengaged from the spray bottle reservoir 15 via a twisting motion thus removing the insert adapter 110 from the liquid tight twist fitting 65; the fill funnel 85 is removed from the lower funnel restraining cavity 90 by use of the funnel grasping means 95 being manipulated against the pressure holding means 100; the dip tubes 80 is then inserted into the desired reservoir compartments 25; appropriate liquid is the poured through the fill funnel 85 filling the reservoir compartments 25; fill process is repeated for the remaining reservoir compartments 25, the orifice plate 30 with the dip tubes 80 is then replaced atop the spray bottle reservoir 15; the orifice plate 30 is secured via the restraining collar 35; the spray nozzle head 20 is engaged with the proper liquid tight twist fitting 65; and, the indicia label 105 are created with pre-made or custom labels.

During utilization of the spray bottle 10, the following procedure would be initiated: the piercing tip 135 of the spray nozzle head 20 is engaged upon the inner collar 115 of the liquid tight twist fitting 65 such that the interior port 140 is engaged upon the respective dip tubes 80 with the keyed prongs 145 engaged upon the keyed lock openings 120 with an angular rotation 150; the trigger handle 55 is operated to spray the desired liquid. Should another liquid be desired, the spray nozzle head 20 is removed from the respective liquid tight twist fitting 65 and engaged upon another; a few activations of the trigger handle 55 are then performed to clean any remaining product from the mechanical pump 60 and the discharge nozzle 50 (preferably into a paper towel or rag), and the new product is dispensed as aforementioned described.

After use of the spray bottle 10, it is stored away until needed again in a similar manner used with all spray containers. It may be refilled as needed or exchanged with new/different liquids as well.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A spray bottle, comprising:

a spray bottle reservoir defining an interior;

an orifice plate located at said top of said spray bottle reservoir secured by a restraining collar, said restraining collar comprising a clamp collar with a restraining clamp;

a spray nozzle head having a main body supporting a discharge nozzle comprising:

a trigger handle; and, a mechanical pump;

a plurality of reservoir compartments each contained within an outer boundary of said spray bottle reservoir and defined by said outer boundary and a plurality of interior dividing walls;

wherein an interior portion of each said interior dividing wall join together at an upper funnel restraining cavity;

wherein each said reservoir compartment include a dip tube, linear in nature and extending from a lowermost section of each reservoir compartment to said orifice plate;

wherein each said dip tube carries a fluid retained within each said reservoir compartment to said spray nozzle head, wherein each said dip tube is presented and routed from said orifice plate to said bottom of said reservoir compartments, wherein when each said dip tubes are placed into a desired reservoir compartments whereupon opening of said dip tubes allows for refilling; and, wherein as said trigger handle is squeezed, said trigger operates said mechanical pump to pressurize and move a respective internal fluid to said discharge nozzle where said respective internal fluid is discharged as an atomized spray.

2. The spray bottle according to claim 1, wherein said spray bottle reservoir and said spray nozzle head are separable to allow for refilling.

3. The spray bottle according to claim 1, further comprising a fill funnel provided on said bottom of said spray bottle where said fill funnel is stored during periods of non-use in a lower funnel restraining cavity.

4. The spray bottle according to claim 3, wherein said lower funnel restraining cavity follows a general profile of said fill funnel.

5. The spray bottle according to claim 1, wherein to remove said fill funnel, a user lifts said spray bottle with 1 hand and grasps said fill funnel with an aid of at least 1 funnel grasping means.

6. The spray bottle according to claim 5, further comprising downward pressure is exerted upon said fill funnel which dislodges it from a pressure holding means.

7. The spray bottle according to claim 6, wherein said pressure holding means is selected from a first group consisting of a pressure fit, a flange fit, or a détente fitting.

8. The spray bottle according to claim 1, wherein said restraining collar is loosened from said orifice plate and removed from said spray bottle reservoir with said dip tubes attached exposing said pie-shaped opening in said top of said spray bottle reservoir.

9. The spray bottle according to claim 8, wherein said restraining collar is selected from a second group consisting of a threaded design, a snap design, or a twist lock design.

10. The spray bottle according to claim 1, wherein said orifice plate is secured by said restraining collar positioned to disclose said liquid tight twist fitting.

11. The spray bottle according to claim 10, wherein said liquid tight twist fitting includes an inner collar with two keyed lock openings.

12. The spray bottle according to claim 11, wherein said liquid tight twist fitting is provided with a self-sealing membrane and an associated inner opening and said self-sealing nature of said liquid tight twist fitting that prevents said liquid from spilling from said spray bottle even if upturned.

13. The spray bottle according to claim 1, further comprising a piercing tip engages a self-sealing membrane where an interior port engages with said respective dip tubes in an air tight manner.

14. The spray bottle according to claim 13, wherein a insert adapter of said spray nozzle head is then aligned with said desired liquid tight twist fitting which contains said desired liquid.

15. The spray bottle according to claim 13, wherein to physically attach said spray nozzle head, said orifice plate and a set of two keyed prongs that engage said respective keyed lock openings are locked into place with a slight angular rotation.

16. The spray bottle according to claim 1, further comprising an indicia label provided on each of said reservoir compartments, centered between said interior dividing walls, wherein rapid identification of said contained liquid is made.

17. The spray bottle according to claim 16, wherein after refilling, said dip tubes are threaded back into each of said reservoir compartments, said dip tubes are replaced in said lower funnel restraining cavity and said spray nozzle head is secured to a desired liquid tight twist fitting by use of an insert adapter.

* * * * *